United States Patent [19]

Kuhlman

[11] Patent Number: 4,606,082

[45] Date of Patent: Aug. 19, 1986

[54] CHAIR LIFT APPARATUS

[76] Inventor: Harvey G. Kuhlman, N56 W21466 Silver Spring Rd., Menomonee Falls, Wis. 53051

[21] Appl. No.: 628,607

[22] Filed: Jul. 6, 1984

[51] Int. Cl.[4] ..... A47K 3/12

[52] U.S. Cl. ..... 4/561; 4/563; 4/560; 5/81 R; 5/87; 280/289 WC; 297/DIG. 4; 414/927; 414/750

[58] Field of Search ..... 4/559–566; 5/81 B, 81 R, 83–84, 87, 89; 280/289 WC, 657; 297/DIG. 4; 137/596; 414/901, 750

[56] References Cited

U.S. PATENT DOCUMENTS

| | | | |
|---|---|---|---|
| 1,635,575 | 7/1927 | Cole | 297/DIG. 4 |
| 2,680,855 | 6/1954 | Robinson | 4/562 |
| 2,686,557 | 8/1954 | Karlsson et al. | 4/563 |
| 3,220,575 | 11/1965 | Batty et al. | 5/81 R |
| 3,228,306 | 1/1966 | Pedersen | 137/596 |
| 3,271,791 | 9/1966 | Sarff | 4/562 |
| 3,654,643 | 4/1972 | Clanan | 5/81 B |
| 3,918,108 | 11/1975 | Feyerherm . | |
| 4,177,807 | 12/1979 | Ocel et al. | 297/DIG. 4 |
| 4,183,106 | 1/1980 | Grimes et al. | 4/563 |
| 4,202,064 | 5/1980 | Joergensen | 5/89 |
| 4,206,523 | 6/1980 | James | 4/562 |
| 4,243,147 | 1/1981 | Twitchell et al. | 414/921 |
| 4,487,019 | 12/1984 | Johansson | 5/81 R |

*Primary Examiner*—Stephen Marcus
*Assistant Examiner*—Linda J. Sholl
*Attorney, Agent, or Firm*—Andrus, Sceales, Starke & Sawall

[57] ABSTRACT

A lift mechanism apparatus for transferring of persons of limited mobility to and from a restricted area such as a raised tub-like water treating facility and in particular such an apparatus which is particularly adapted for transfer from and to a wheelchair without requirement of the individual standing during the transfer process.

18 Claims, 9 Drawing Figures

CHAIR LIFT APPARATUS

BACKGROUND OF THE PRESENT INVENTION

This invention relates to a chair lift apparatus and particularly to such an apparatus for transfer of a person from a wheel chair or the like into a restricted area.

Certain persons for various reasons have limited mobility. Depending upon the degree of immobility, the person may be restricted to the use of a wheelchair or similar device for movement from one place to another. Many such persons with greater degrees of mobility which permit them to walk with a walker and the like also have great difficulty, however, in entering and leaving a bathing or other water-treating tub.

Various chair lift type devices have been developed and suggested for assisting, transporting and transferring of such persons into and from a bathing facility. For example, U.S. Pat. No. 3,852,835 which issued Dec. 10, 1974 discloses a sling-mounted chair secured to an overhead and hydraulically positioned support. The unit includes a plurality of flexible support elements interconnected to a common point to define a tripod-type universal pivotal support. The person, when in the sling-mounted chair, can be moved upwardly by a pulley arrangement in which the total chair lift is moved over and from alignment with the tub. Lowering and raising from the tub are provided and are effected through the same action as the entrance and removal of the individual. Various other similar alternate supports are shown in U.S. Pat. Nos. 2,680,955 3,104,399, and 3,465,371.

Although various systems have been suggested the inventor has not found any commercially available unit which provides a reliable and totally stable means of transferring a person of significant immobility from and to a bathing facility. This is particularly true with respect to persons who have significant difficulty in standing during the transfer process.

There is therefore a substantial need for a transfer mechanism which provides a very stable and reliable movement of a relatively immobile person to and from a tub-like facility, particularly permitting the transfer without the necessity of a standing movement from a wheelchair.

SUMMARY OF THE PRESENT INVENTION

The present invention is particularly directed to a lift mechanism apparatus for transferring of persons of limited mobility to and from a restricted area such as a raised tub-like water treating facility and in particular such an apparatus which is particularly adapted for transfer from and to a wheelchair without requirement of the individual standing during the transfer process.

Generally, in accordance with the teaching of the present invention, the transfer mechanism includes a carriage rigidly mounted in supporting relation overlying the water-treating facility such as a bathtub and moving transversely thereof. The carriage is slideably supported on a suitable track means which extends from the facility to the area adjacent to the facility. A suitable drive and preferably a hydraulic powered unit or other hudraulic drive is coupled to the carriage for moving thereof along the track means. A powered cylinder unit is affixed to the carriage and depends downwardly therefrom. A chair unit is secured to the extended end of the movable element of the powered cylinder unit, raising and lowering with respect to the bathtub. The hydraulic system is specifically constructed to prevent the weight of the person and chair unit from over-riding the powered movement of the chair unit to avoid all or any uncontrolled movement. A remote and/or a suitable chair located control means is provided for controlling the flow of hydraulic liquid to the powered cylinder units for the selective raising and lowering of the chair unit, as well as traversing of the chair unit and from alignment with the bathtub. The essentially total hydraulic control system has been found to provide a smooth reliable control without the usual dangers associated with electrical powered systems. The action and movement of the system is smooth and accurately controlled by the operator to permit the safe and reliable transport of the party to and from the bathtub.

In a preferred construction of the present invention, the special wheelchair is provided for use with and in joint operation with the lift mechanism. The wheelchair includes a back structure which is adapted to be released such that the party can move directly from the wheelchair seat onto the lift seat without rising from the wheelchair or standing.

More particularly, in a preferred embodiment of the present invention, the track consists of one or more rigid shafts or rails secured to and spaced slightly from the ceiling overlying the bathtub. A carriage includes a pair of support bearing members journaled on the rails for sliding movement thereon. A hydraulic-cylinder unit is secured to the ceiling structure and includes a piston-rod and cylinder, one end which is secured to the carriage for positioning the carriage on the supporting rails. A self-contained hydraulic supply unit is coupled to an electrically driven pump means and housed within a suitable enclosure secured to adjacent area or to the carriage. A suitable hydraulic pump means is provided with the supply lines extended along the rails to the end of the assembly for connection to the supply unit with the unit on the carriage. The hydraulic plumbing lines are coupled to and from the hydraulic supply unit to the opposite ends of the power cylinder through a suitable directional control valve in the unit for selective movement of the power cylinder and corresponding to the carriage on the rails. A vertical cylinder unit is secured to the carriage with a piston-rod extending downwardly to an interconnected chair unit. Rigid plumbing lines are connected along the chair cylinder and connected to the opposite ends and are connected by suitable lines to the supply unit. The lowering system preferably includes an anticavitation and antidrop means preventing overrunning of the system as a result of the weight of the person in the chair, which might act as a pumping force on the hydraulic cylinder unit. A three-way reversing valve may be provided for raising and lowering of chair cylinder and corresponding raising and lowering of the chair.

A small pump unit is also provided in our embodiment, secured to the chair lift and operable to produce water jets with the chairlift within the body of water. The pump unit is hydraulicaly driven with the supply lines coupled to the source via suitable lines extending upwardly adjacent the vertical positioning cylinder unit. The supply unit includes a control valve for controlling operation of the pump unit.

The present invention has been found to provide a simple, reliable and effective power lift chair apparatus for placement and removal of a party with respect to a bathing tub.

BRIEF DESCRIPTION OF DRAWINGS

The drawings furnished herewith illustrate a preferred construction of the present invention in which the above advantages and features are disclosed as well as others which will be readily understood from the following description of such embodiment.

In the drawings

DESCRIPTION OF ILLUSTRATED EMBODIMENT

Figure 1:
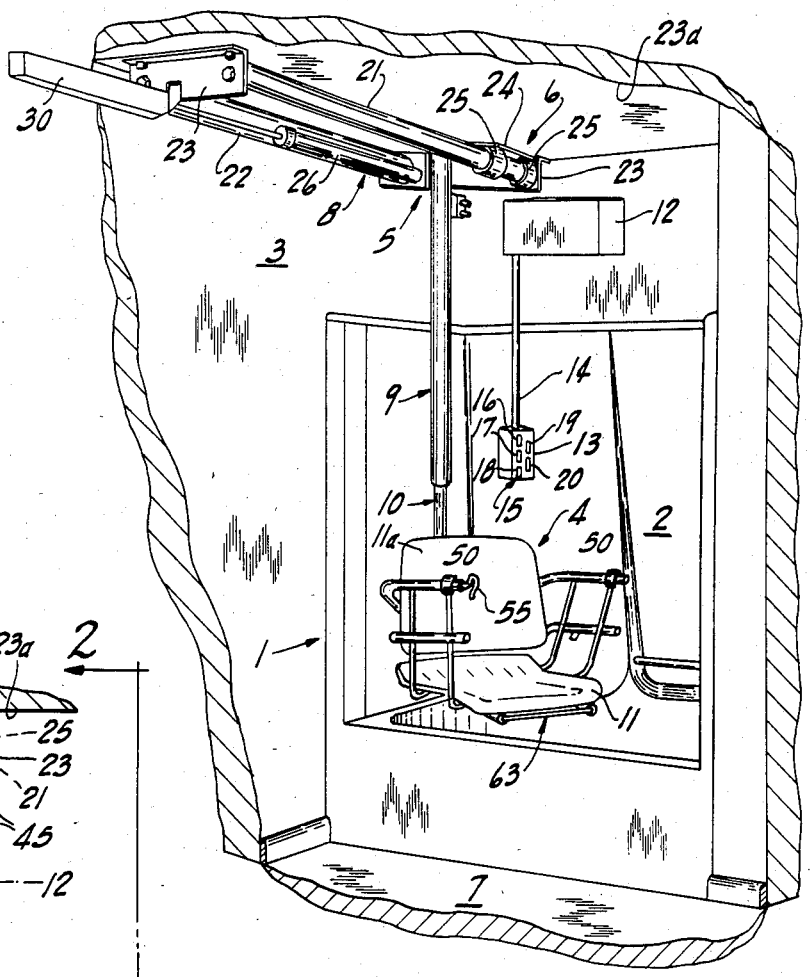
FIG. 1 is a pictorial view of the improved chairlift apparatus constructed in accordance with the teaching of the present invention.
Figure 3:
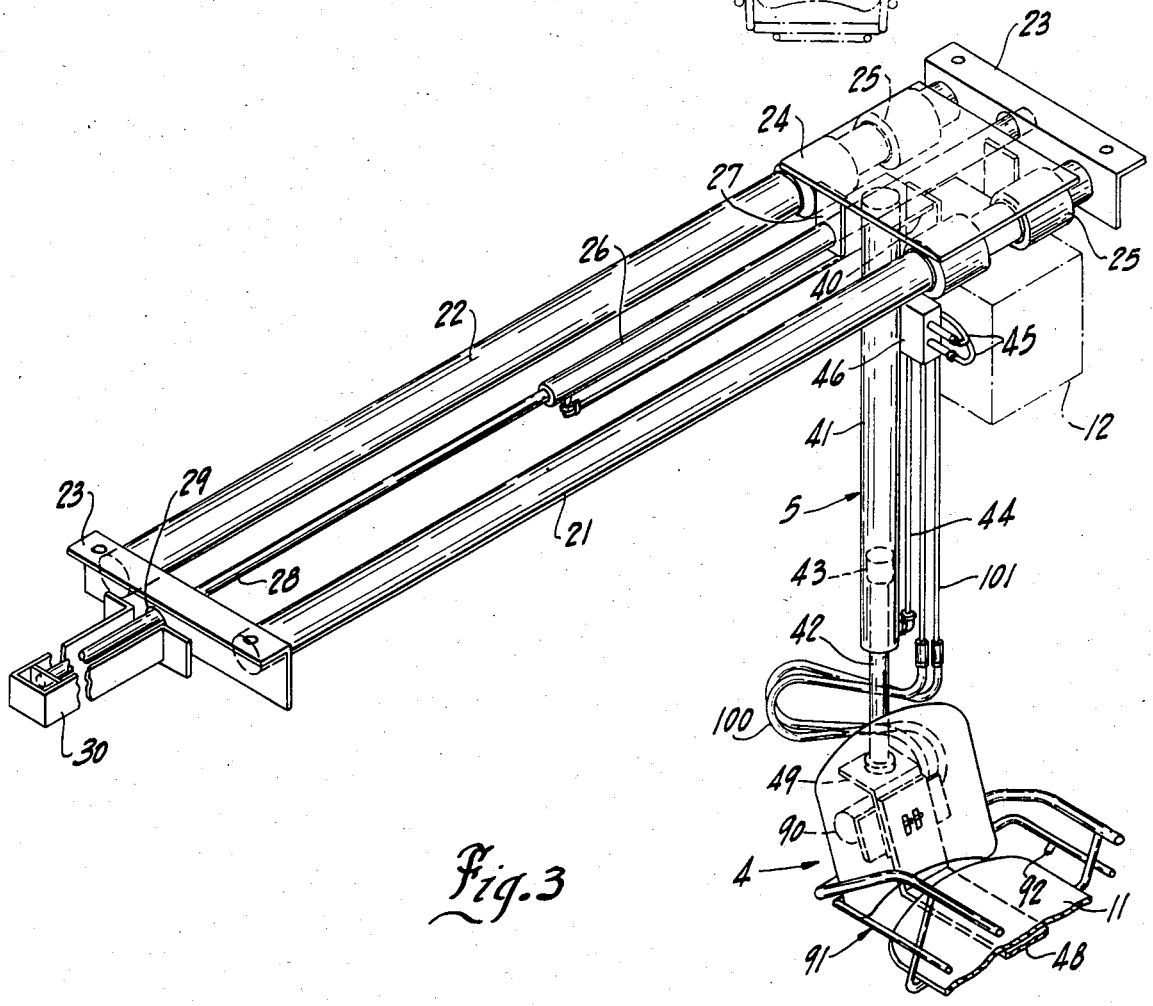
FIG. 3 is a perspective view of the apparatus shown in FIGS. 1 and 2.
Figure 4:
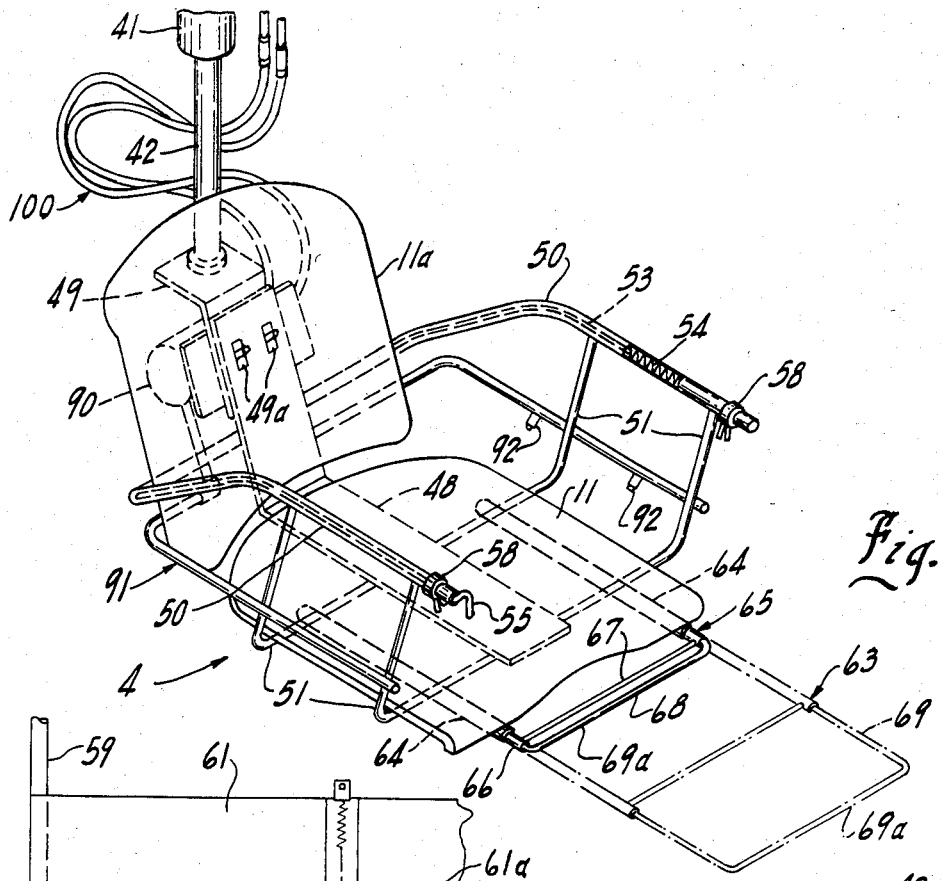
FIG. 4 is fragmentary perspective view more clearly illustrating the detail of the chair unit shown in FIGS. 1–3.

Referring to the drawing and particularly to FIGS. 1 and 3, a powered chairlift apparatus 1 is illustrated mounted in relationship to a bathtub 2 within a conventional room or enclosure 3. The chairlift apparatus 1 includes a chair unit 4 interconnected to a ceiling support unit 5 for vertical positioning with respect to the bathtub 2 and for transverse positioning with respect to the bathtub 2. The ceiling support unit 5 extends perpendicular to the principal dimension of the bathtub 2 and includes a carriage unit 6 adapted to move between alignment with the bathtub 2 and alignment with the floor area 7 immediately adjacent to the entrance side of the bathtub. A hydraulic powered cylinder unit 8 is coupled to the carriage unit 6 for moving thereof in the transverse direction. A depending power cylinder unit 9 is secured to the carriage unit 6 and includes a depending piston rod 10 to which the chair unit 4 is firmly affixed. The chair unit 4 is shown as a substantially rigid unit having a rigid seat 11 and rigid back 11*a* for firmly supporting the person being moved. The operation of the power cylinder unit 9 raises or lowers the chair unit 4. An electrically operated hydraulic supply unit 12 is separately mounted adjacent to the area, as shown, or may be mounted to the carriage unit 6, as shown in phantom in FIG. 5. The supply unit 12 is connected, as herinafter described, to the power cylinder units 8 and 9 for establishing the respective defined movements. A low voltage control unit 13 is connected by a corresponding low voltage cable 14 to the supply unit 12. The control unit 13 includes appropriate selection buttons 15 for establishing the respective movements. The control buttons 15 include an on-off button 16, a rise or up button 17, a lower or down button 18 as well as a left or out button 19 and a right or in button 20.

The rigid structure provided by the powered cylinder units in combination with the hydraulic actuation for all movement results in an extremely stable, smooth and reliable lift chair particularly adapted for the safe and comfortable movement and positioning of people with physical disabilities.

Figure 2:
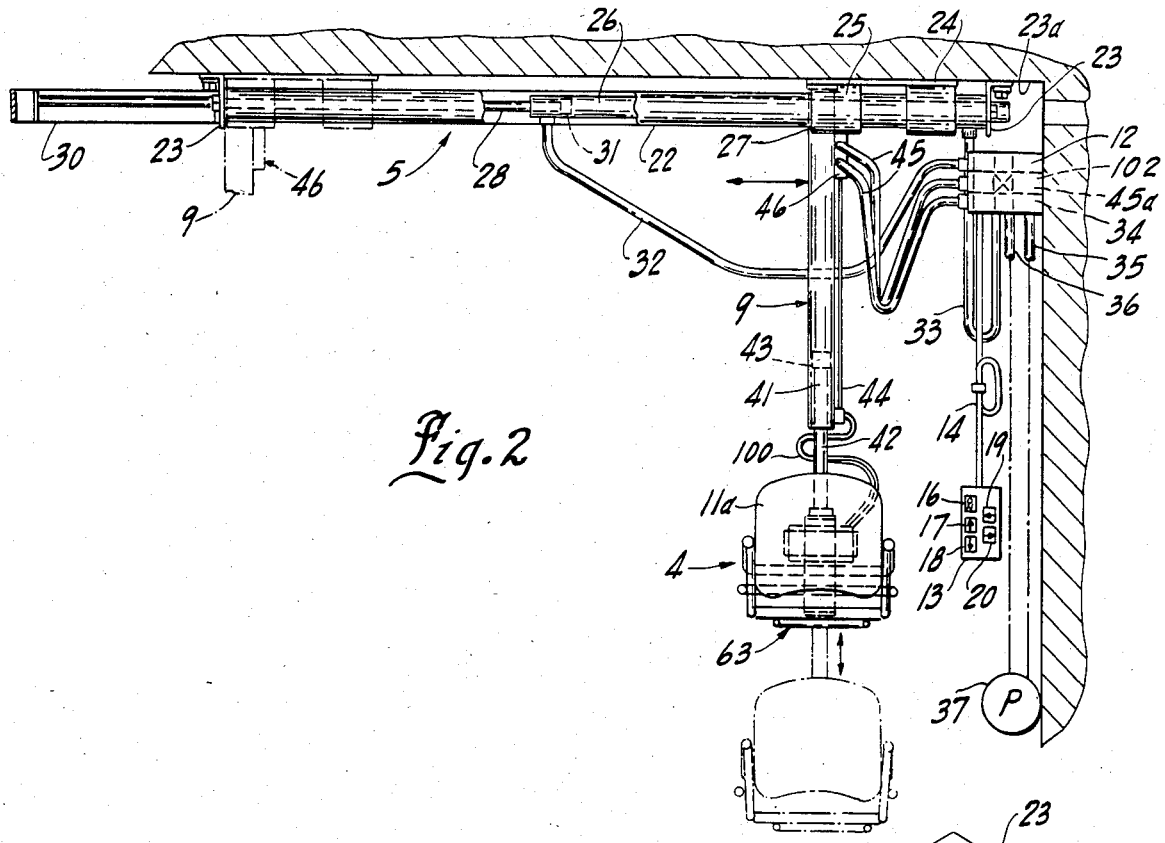
FIG. 2 is front elevational view taken generally on line 2—2 of FIG. 1 and illustrating the mounting of the apparatus as shown in FIG. 1.

More particularly in the illustrated embodiment of the invention, the support unit includes a pair of support rails 21 and 22 shown as rigid shaft member. Mounting brackets 23 are similarly secured to the opposite ends of the rails. The brackets 23 are L-shaped members having one leg bolted or otherwise rigidly affixed to the adjacent end of the rails 21–22 and the opposite leg abutting and bolted or otherwise rigidly affixed to the ceiling 23*a*. The rails 21–22 are located to span the bathtub 2 and project outwardly therefrom into the adjacent floor area 7. The rails 21–22 are located in slightly-spaced relation to the ceiling and is secured thereto by rigid L-shaped mounting brackets 23. The carriage unit 6 includes a heavy metal plate 24 spanning the rails 21–22. Similar supporting bearings 25 are secured to the underside of plate 24 and are slideably journaled on the respective aligned rails 21–22 to provide a firm and reliable plate support with stable and smooth movements of the carriage unit 6. The power cylinder unit 8 for moving of the carriage 6 includes a power cylinder 26 extending longitudinally between the rails 21 and 22. The cylinder 26 extends beneath and to the opposite sides of the carriage plate 24 by a depending bracket 27. A piston rod 28 extends through a sealed opening in one end of the cylinder 25 and extends outwardly to the exterior area of the bathtub 2. The piston rod 28 extends through an opening 29 and in end mounting bracket 23. A bracket 30 is secured to the ceiling bracket 23 and to the outer end of the piston rod 28 to rigidly and fixedly support the outer end of the piston rod in place. A piston 31 is secured to the piston rod. Supply lines 32–33 are connected to the opposite ends of the powered cylinder 26 and the hydraulic control unit 12. An electrically operated valve 34 of control unit 12 couples the lines 32–33 to a pair of supply lines 35 and 36 one of which is pressurized and the other of which is a return line to the connection to lines 32 and 33 controls the pressurization of the one line and releasing of pressure of the opposite line. Valve 34 is a suitable four-way valve which permits the system to supply pressurized liquid to either line 32 and 33 with the opposite line connected to the return line. Check valves in the lines prevent the free flow of liquid from the cylinders. An electric motor-driven pump 37 is shown connected to the supply unit 12 (FIG. 2) to establish a continuous supply of suitable pressurized hydraulic liquid to lines 35 and 36. With the outer line 32 pressurized, pressurized liquid is supplied between the piston 31 and the other or left end of the cylinder 26, as viewed in FIG. 2. The piston and piston rod is fixed in place and consequently the corresponding end of the cylinder moves outwardly of the bathtub 2 carrying the carriage unit 6 outwardly of the bathtub 2. This, of course, repositions the chair unit 4 in the adjacent outer area 7. Conversely, connecting the left side line 33 in FIG. 2 to the power supply and the opposite line 32 to the return side results in reverse movement of the cylinder 26 for aligning the carriage unit 6 with the bathtub 2 for corresponding alignment of the raised lift chair unit 4. The moving cylinder 26 extends a distance sufficient to allow complete movement of the chair unit 4 laterally of the bathtub 2. This may require projection of the cylinder 26 past the inner wall. In the illustrated embodiment of the invention, the cylinder 26 is shown extended through an appropriate opening in bracket 23 and the adjacent wall to accommodate the required movement.

The chair cylinder unit 9 is secured to the carriage plate 24. In particular, a mounting plate 4 is rigidly welded or otherwise rigidly affixed to the end of the cylinder 41 of unit 9 and to the carriage plate 24. The cylinder 41 depends downwardly. A piston rod 42 extends from the lower end of the power cylinder 41 to the chair unit 4. The piston 43 in the cylinder 41 provides for hydraulic positioning of the piston rod 42 and interconnected chair unit 4. Rigid supply lines or conduits 44 interconnect the opposite ends of the chair cylinder 41 to a pair of flexible lines 45 connected to the hydraulic control unit 12 for selective application of the hydraulic pressurized liquid to one end of the power cylinder 41 for corresponding positioning of the piston rod 42 and interconnected chair unit 4. The supply unit 12 thus includes a second four-way valve unit **45*a* for selective connection of the lines 45 and conduits 44 for opposite movement and positioning of the chair power cylinder 41. A drop-control valve 46 is connected in the line 44 connected to the lower end of the cylinder 41 and the supply. The drop-control valve 46 positively prevents the unrestricted and uncontrolled flow of the hydraulic liquid from the chair cylinder 41 to the supply. The drop-control valve 46 thus prevents the weight of the chair and person in the chair unit 4** from acting as a power drive on the cylinder to create a pumping action and uncontrolled movement of the chair unit during a lowering operation.

Although the chair unit 4 may be of any suitable construction, a preferred and unique unit is disclosed in the illustrated embodiment. The chair unit 4 consists of an L-shaped frame 48 to which the rigid back member **11*a* and seat 11 is secured in any suitable manner. The piston rod 42 is secured to the back leg of bracket or frame 48 of the chair. In the illustrated embodiment of the invention, an adjustable L-shaped mounting bracket 49 is secured to the end of the piston 42 and bolted to the back frame of the chair unit 4. The bracket 49 is adjustably secured to the chair unit 4 as by a slotted connection to adjust the lower most position of unit 4 so as to prevent the chair from bottoming onto the tub or floor area. The chair further includes side-arms 50 for laterally confining the person sitting in the chair. The side arms 50 are formed by a U-shaped member secured to the back frame 48 and extended about the opposite sides of the seat back. A pair of similar U-shaped side arm supports 51 are secured to the base of frame 48 and extending upwardly about the seat of chair unit 4 to the side arms 50. Supports 51 are welded or otherwise rigidly affixed to side arms 50**.

Figure 6A:
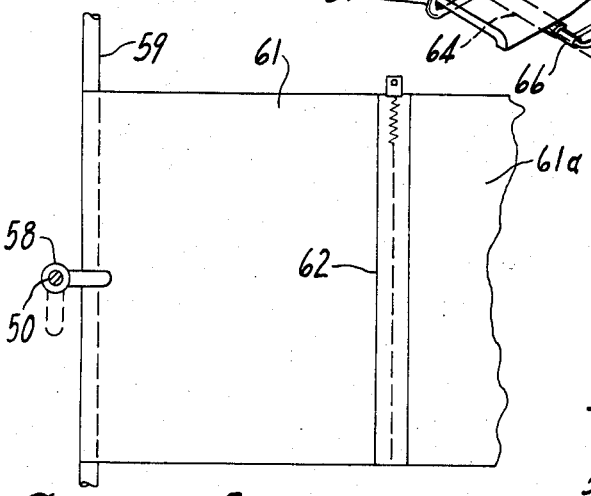
FIG. 6A is a view taken generally on line 6A—6A of FIG. 6.
Figure 6:
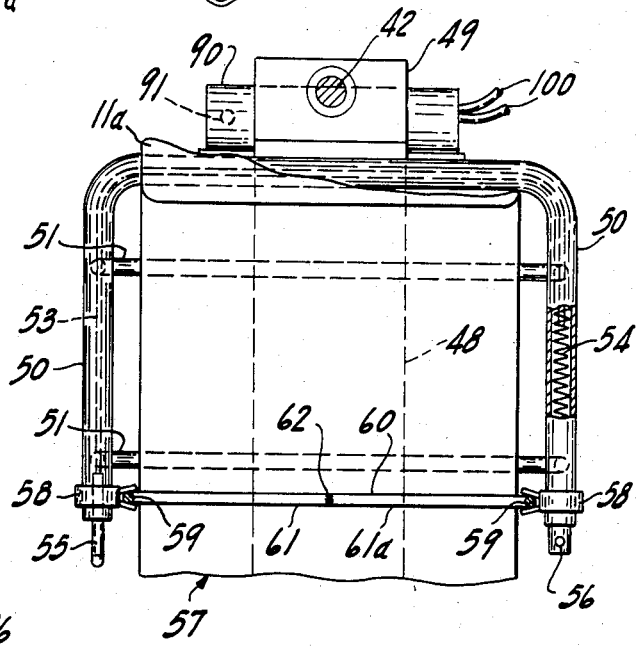
FIG. 6 is an enlarged top view clearly illustrating the coupling of a wheel chair to the chairlift unit.
Figure 7:
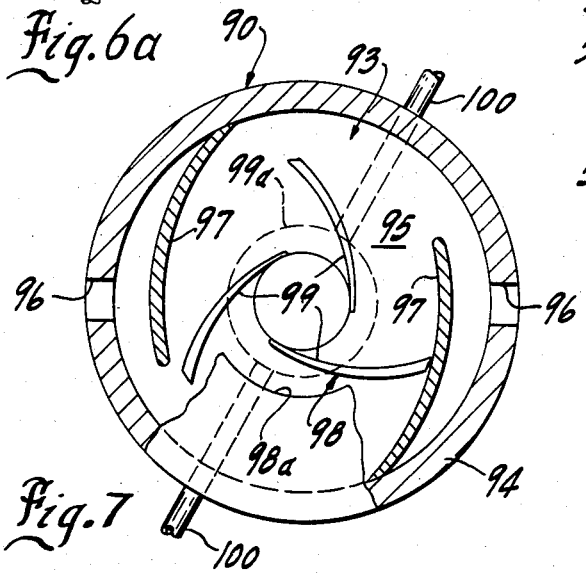
FIG. 7 is a view of the motor-pump unit, with parts broken away and sectioned.

A safety belt 53 is releasable provided for spanning the entrance to the chair unit 4. The illustrated safety belt 53 has one end secured extending within the side arms as shown in FIG. 6 and extended to a spring member 54. The exterior end of the belt 53 terminates in a hook 55 which is adapted to be releasably secured into an opening 56 in the opposite chair side arm 50.

Figure 5:
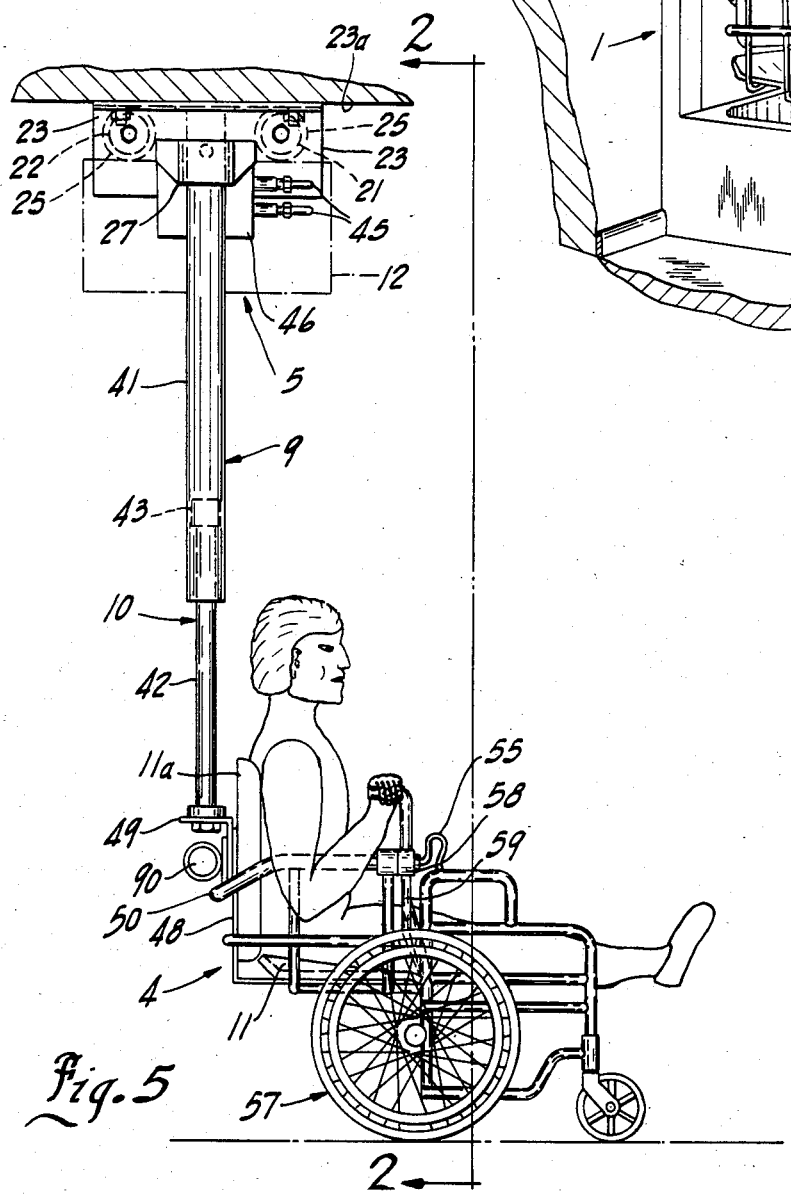
FIG. 5 is a side view illustrating the positioning of a person from a wheelchair into the chairlift shown in FIG. 1–4.

The rigid chair structure is particularly convenient and desirable for transfer of a person into a special wheelchair 57, shown in FIGS. 5 and 6. The chair unit 4 is provided with a pivotal catch 58 on each side arm 50 for coupling the chair unit 4 to the wheelchair 57. The catch 58 is shown as a generally U-shaped member pivotally mounted on the outer end portion of each side arm. Thus, with the wheelchair in place, the catch 58 is pivoted over the aligned vertical post 59 of the wheelchair to releasably couple the chairs to each other for safe transfer therebetween.

Referring particularly to FIGS. 5 and 6, wheelchair 57 is further especially constructed with a removable back shown as a split back 60 having left and right portions 61 and **61*a*. Each half is secured to the vertical side post or member of the wheelchair frame. The back 60 is formed of a flexibly material and is movable outwardly to open the back of the wheelchair 57. In the illustrated embodiment of the invention, the suitable flexible back is secured to the side member in a conventional manner by wrapping about the member. The center edges of the back members 60–61 are interconnected by a zipper 62. The person is moved from the wheelchair 57 on to the lift chair unit 4 by placing the wheelchair backed up to the lift chair and coupled thereto by latches 58. The back of the wheelchair is then opened and the person can conveniently slide directly from the wheelchair on to the smooth seat of the lift chair unit 4**.

An extendable leg support unit 63 is shown secured to the underside of the chair seat. The unit 63 includes a pair of tubes 64 secured to the underside of the chair seat and particularly to the base of the U-shaped member 51. A generally U-shaped member 65 includes side arm 66 telescoped into the tubes 64. The side arms 66 are connected by a forward cross member 67 spaced slightly inwardly of the ends of arm 66. A second U-shaped wire member 68 includes side arm rods 69 telescoped into the side 5 tubes 64 and interconnected by an integral outer cross arm **69*a*. Thus, U-shaped members 65 and 68 are successively movable outwardly beneath the seat of the wheelchair 57** for interconnection to the wheelchair to positively locate the lift chair and the wheelchair in alignment.

Thus, in operation the backside of the wheelchair is opened, the chair moved rearwardly and telescoped into the unit 63 and projecting portion of the lift seat for convenient movement of the person onto the lift chair. The wheelchair catches are attached. The person is then transferred. The wheelchair is then removed and the person thus located within the lift chair. The persons legs may be supported by the extending support.

The controls are then actuated either directly by the person, or by an attending person, to lift the chair and the person above the level of the bathtub 2. The transfer power cylinder unit is then actuated to the chair laterally into alignment with the bathtub 2. Finally the control unit is actuated to slowly and safety lower the chair and person into the bathtub 2.

The reverse sequence is, of course, executed to remove the person from the bathtub 2.

Figure 8:
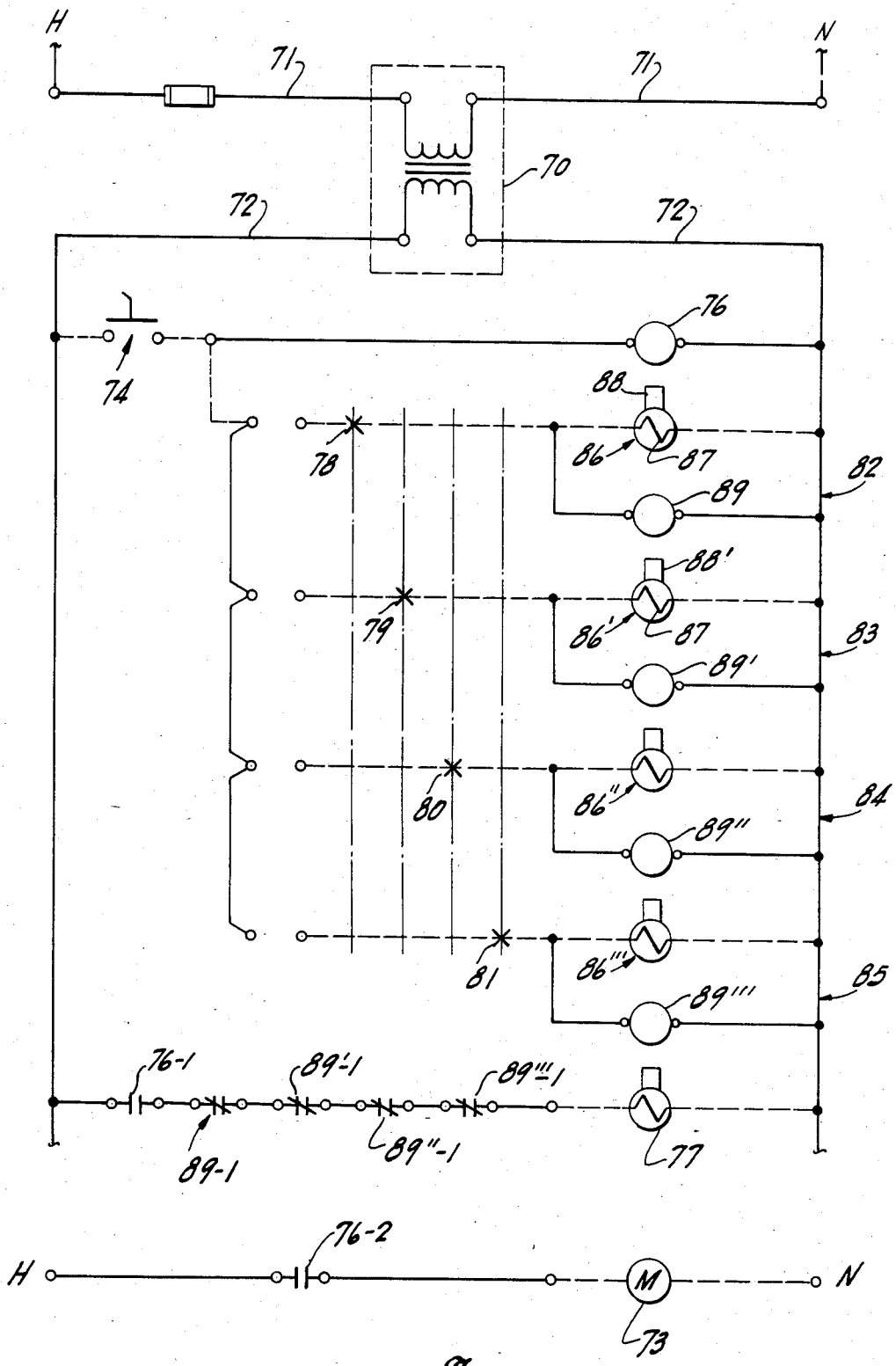
FIG. 8 is a schematic circuit of a control unit.

A suitable operating control circuit for the chair lift is shown in FIG. 8. The illustrated circuit includes a main power transformer/converter 70 connected to the incoming power lines 71. The transformer/converter 70 reduces the conventional 120 volts AC to a 24 volt DC power supply. The output of the 24 volt supply is interconnected to control lines 72 for operating of the hydraulic pump motor 73 and various solonoids for positioning of the power cylinder units 8 and 9. The circuit is shown in a line diagram between the supply lines 72 with each of the cross lines identified by an L-number. The control circuit includes a start branch line L-5 having an on/off switch 74 coupled to the control button 16 and connected therein for selective supply of power to the control unit and the operating components in the power supply unit. Thus, the on/off switch 74 is mounted in the control unit 13 and connected by a suitable cable to the power supply unit as shown by the dashed lines.

The main control switch 74 supplies power to a start relay 76 in line L-5, and simultaneously supplies power to the cylinder control switches located in the control unit. Actuation of the start relay 76 closes a first set of normally open contacts 74-1 in a branch line L-14. Closing of the contacts 74-1 completes a circuit to a bypass solonoid valve 77. Simultaneously, a second set of contacts 76-2 shown at line L-16 are also closed. The second set of contacts 76-2 are connected in the series with the hydraulic pump motor 73 for driving of the pump unit and establishing the pressurized flow of hydraulic liquid. The simultaneous actuation of the pump and the bypass valve permits the pump unit to initiate and build up a flow of high pressure liquid for suitable operation of the power cylinder unit 8 and 9.

More particularly, referring to the lift circuit section, a raise or lift solonoid valve unit 86 includes an operating coil 87 for opening and closing a valve 88. The one side of coil 87 is connected to the return side of the 24-volt DC supply line 72. The opposite side of the coil 87 is connected in series with the "up" control switch 78 which is coupled to the control button 17 and to the on/off switch 74. Thus, when the on/off switch 74 is closed and power is supplied to the lift control, the closing of "up" switch 78 supplies power to the "up" solonoid valve 86. This positions valve 88 to supply power to the lower end of the lift cylinder and simultaneously connects the upper end of the lift cylinder to the return side of the hydraulic supply lines. As a result the chair unit 4 is carried upwardly by the piston rod. When it reaches the uppermost position the flow of course terminates and the unit is hydraulically locked in the raised position.

Simultaneously with the actuation of the lift solonoid valve, an interlock relay 89 in line L-7 is energized. The relay 89 is as shown connected directly in parallel with the lift solonoid valve 86. The relay 89 controls a set of normally closed contacts 89-1 connected in the bypass valve line L-14. Thus, during the lifting operation the bypass valve is de-energized and the bypass valve closes thereby connecting the power cylinder directly in circuit. During the operation of one power cylinder unit, the other power cylinder unit is hydraulically locked in place. Thus, while raising or lowering of the chair, the transverse solonoid valves lock the lines to the opposite ends of the power cylinder and creates a hydraulic lock across the piston. The hydraulic lock holds the piston in the last position location to firmly lock the carriage and the interconnected chair in the desired transverse position.

Each of the other transfer or moving cylinder control sections 83–85 is identical to that of section 82 for interconnecting of the corresponding cylinder to the hydraulic supply lines, and simultaneously opening corresponding contacts in the bypass valve branch circuit. Consequently, further detailed description of the elements are not given herein.

The illustrated circuit provides a simple and inexpensive control system employing conventional solonoid valves and relay. Obviously any other system control circuit can be readily provided such as well-known solid state switching and relaying circuits. In any event the control should include the low voltage control to permit convenient and safe usage in the environment of the bathroom.

The low voltage control, of course, permits completely reliable and safe usage and application in a water environment.

The chair and the piston rod at least are formed of a suitable material to allow direct immersion into the bath water. For example, the frame of the chair, the piston rod may be conveniently formed of stainless steel or other suitable material. The chair seat and back is conveniently formed of a suitable molded plastic which can be readily immersed in hot water and the like.

In addition, various auxiliary devices can, of course, be interconnected to the chair unit. For example, in the illustrated embodiment of the invention, a hydro-jet pump unit 90 is secured to the backside of the chair. The pump unit includes a U-shaped discharge pipe 91 extending about the back and sides of the chair. Spray nozzles 92 are provided in the sides of the chair 4. A small pump 93 is connected to provide the necessary pumping power for circulating of the water from the tub. The water jet pump may, for example, be any suitable hydraulically actuated pump. The inventor has built a special dual discharge pump of a rotating vane type unit to provide the desired high volume flow desired. The pressure requirements are minimal. The pump includes housing 94 formed with an inner impeller cavity 95 having a pair of opposed discharge openings or passageways 96 formed on the opposite sides. Each discharge passageway 96 includes a tapered inner wall 97. The impeller 98 is rotatably mounted within the cavity and includes a series of circumferentially spaced impellers or vanes 99 rotating within the chamber 95 and forcing the water from a center inlet **98*a* into the respective output passageways 96. A small fluid motor 99*a* is coupled to the impeller for operating the pump. Flexible supply line 100 connect the motor 99*a* to the supply unit 12 which includes a two-way valve 102 for selectively connecting the motor 99*a* to the pressurized lines. The valve 102 is, of course, controlled from the small control unit 13**.

The rigid-type chair in combination with the rigid mounting and the fluid-power cylinder positioning of the chair creates a very reliable chairlift with maximum safety and reliability of positioning the person with respect to the bathtub. The apparatus uses present-day technology for convenient maintenance construction and installation.

I claim:

1. A power chair lift apparatus for moving of a person from and to a restricted area, comprising a horizontal hydraulic piston-cylinder power unit adapted to be rigidly affixed in upwardly spaced relation above a restricted area and having a movable member movable transversely into and from said area, a carriage secured to said movable member of said horizontal hydraulic power unit for selective positive positioning in alignment with the restricted area and outside said restricted area, a chair lift power piston-cylinder unit fixedly secured to said carriage and depending downwardly thereform to define a firm support, said chair power piston-cylinder unit including a vertically movable member, a chair unit secured directly to said movable member of said chair power unit for corresponding positive vertical positioning, hydraulic fluid supply means for said power piston-cylinder units, and a control means for selectively connecting said hydraulic fluid supply means to the opposite ends of said power units for corresponding positioning of the carriage and the chair.

2. The chair lift apparatus of claim 1 wherein said hydraulic fluid supply means is secured to said carriage and includes an electrically controlled valve means, and a low voltage control unit connected by a low voltage cable to said control unit for controlling said electrically controlled valve means.

3. The apparatus of claim 1 wherein said chair unit consists of a rigid frame, a rigid seat member secured to said frame and a rigid back member secured to said frame, said back member being rigidly affixed to said depending power cylinder unit for vertical positioning of said chair, said depending power cylinder being free to swivel for selective positioning of the chair.

4. The apparatus of claim 1 wherein said chair includes a substantially rigid seat and having an extendable support means secured to said chair and adopted to be extended outwardly or a rigid extension substantially in the plane of the chair seat.

5. The apparatus of claim 1 wherein said supply means is secured to said carriage, said cylinder units each including a cylinder, said supply means including flexible line means and rigid conduit means are connected between said flexible line means of said supply means and the opposite ends of said power cylinders, and valve means selectively connecting said conduit means to said supply means.

6. The apparatus of claim 1 wherein said horizontal power unit includes a movable cylinder secured to said carriage and a piston rod extending from one end of the cylinder, the other end of said piston rod having mounting means adapted to being secured in fixed relation to said area.

7. The apparatus of claim 6 wherein rigid hydraulic lines are connected to said opposite ends of said cylinder, and flexible lines connect said supply means to said rigid lines.

8. The apparatus of claim 6 wherein said chair piston-cylinder unit includes a fixed cylinder secured to said carriage and a piston rod extending downwardly therefrom and connected to said chair.

9. The chair lift apparatus of claim 1 wherein said hydraulic fluid supply means is secured adjacent said restricted area, said supply means includes electrically controlled valve means for said power piston-cylinder units, a low voltage control unit connected by a low voltage cable to said control unit for controlling said electrically controlled valve means, said horizontal power piston cylinder unit includes a movable cylinder secured to said carriage and a piston rod extending from one end of the cylinder, the other end of said piston rod having mounting means adapted to being secured in fixed relation to said area, and said chair piston-cylinder unit includes a fixed cylinder secured to said carriage and a piston rod extending downwardly therefrom and connected to said chair, rigid fluid lines are connected to the opposite ends of said cylinders, and flexible fluid lines connect the said rigid fluid lines to said valve means of said supply unit.

10. The apparatus of claim 9 wherein said chair unit consists of a rigid frame, a rigid seat member secured to said frame and a rigid back member secured to said frame, said back member being rigidly affixed to said depending chair cylinder unit for vertical positioning of said chair.

11. The apparatus of claim 9 wherein said chair includes a substantially rigid seat and having an extendable support means secured to said chair to form a fixed extension of said rigid seat, and adapted to be extended outwardly substantially in the plane of the chair seat.

12. The chair lift apparatus of claim 1 including rail means as a part of said power unit, said carriage includes a rigid plate having bearing means riding on said rail means and rigid supply lines extend along said cylinders and connect the opposite ends of said cylinders to said supply means.

13. The apparatus of claim 12 wherein said hydraulic fluid supply means is mounted adjacent said bathtub and includes an electrically controlled valve means, flexible lines secured to said carriage and said supply means and connected to said rigid supply lines and said valve means.

14. The apparatus of claim 1 wherein said chair unit consists of a rigid frame, a rigid seat member secured to said frame and a rigid back member secured to said frame, side members secured to said seat member and back member, and a releasable tie means connected between side members for releasably securing a person in said chair unit.

15. The apparatus of claim 14 having an extendable support means secured to said chair and adapted to be extended outwardly as a rigid extension of the chair seat substantially in the plane of the chair seat.

16. The apparatus of claim 15 wherein said horizontal power unit includes a movable cylinder having a central portion secured to said carriage and a piston rod extending from one end of the cylinder, the other end of said piston rod having mounting means adapted to being secured in fixed relation to said bathtub.

17. A power chair lift apparatus for moving of a person from and to a restricted area, comprising an horizontal power unit adapted to be rigidly affixed in upwardly spaced relation above a restricted area and having a movable member movable transversely into and from said area, a carriage secured to said movable member of said horizontal power unit for selective positioning in alignment with the restricted area and outside said restricted area, a chair lift power piston-cylinder unit secured to said carriage and depending downwardly therefrom, said chair power piston-cylinder unit including a vertically movable member, a chair unit secured to said movable member of said chair power unit for corresponding vertical positioning, hydraulic fluid supply means for said power cylinder units, and a control means for selectively connecting said hydraulic power fluid supply to the opposite ends of said power units for corresponding positioning of the carriage and the chair, said chair unit includes a rigid support chair seat, a wheelchair unit having a seat on substantially the level of the chair seat and a removable back, and means to selectively couple said wheelchair to said chair unit with said removable back adjacent the entrance to said chair seat.

18. The power chair lift apparatus of claim 17 wherein said chair unit includes an extendable support means adapted to be extended outwardly to define a horizontal support substantially in the plane of the chair seat.

* * * * *